US009119270B2

(12) United States Patent
Chen et al.

(10) Patent No.: US 9,119,270 B2
(45) Date of Patent: Aug. 25, 2015

(54) SOLID STATE LIGHTING DEVICE AND DRIVER CONFIGURED FOR FAILURE DETECTION AND RECOVERY

(71) Applicants: Keng Chen, North Andover, MA (US); Christian Breuer, Newburyport, MA (US); Markus Ziegler, Watertown, MA (US)

(72) Inventors: Keng Chen, North Andover, MA (US); Christian Breuer, Newburyport, MA (US); Markus Ziegler, Watertown, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 248 days.

(21) Appl. No.: 13/904,444

(22) Filed: May 29, 2013

(65) Prior Publication Data

US 2014/0097761 A1 Apr. 10, 2014

Related U.S. Application Data

(60) Provisional application No. 61/709,869, filed on Oct. 4, 2012.

(51) Int. Cl.
*H05B 37/00* (2006.01)
*H05B 33/08* (2006.01)

(52) U.S. Cl.
CPC ..... *H05B 33/0893* (2013.01); *H05B 33/0827* (2013.01)

(58) Field of Classification Search
CPC ..... H05B 33/0875; H05B 33/0881; H05B 33/0884; H05B 33/089
USPC ..... 315/192, 297, 307, 308
See application file for complete search history.

(56) References Cited

U.S. PATENT DOCUMENTS

| | | | | |
|---|---|---|---|---|
| 7,876,103 | B2 | 1/2011 | Mihai et al. | |
| 8,253,339 | B1 * | 8/2012 | Godbole et al. | 315/149 |
| 8,344,661 | B2 * | 1/2013 | Hsu et al. | 315/307 |
| 8,456,094 | B2 * | 6/2013 | Huang et al. | 315/192 |
| 8,471,483 | B2 * | 6/2013 | Lee et al. | 315/192 |
| 8,878,445 | B2 * | 11/2014 | Takata et al. | 315/192 |
| 8,896,319 | B2 * | 11/2014 | Liao et al. | 324/537 |
| 2007/0013321 | A1 | 1/2007 | Ito et al. | |
| 2010/0156324 | A1 | 6/2010 | Nagase et al. | |
| 2012/0074856 | A1 | 3/2012 | Takata et al. | |
| 2012/0212141 | A1 | 8/2012 | Ryu et al. | |

FOREIGN PATENT DOCUMENTS

WO 2008/061301 A1 5/2008

OTHER PUBLICATIONS

Jesus Maicas, International Search Report and Written Opinion of the International Searching Authority for PCT/US2013/063424, Aug. 13, 2014, pp. 1-8, European Patent Office, Rijswijk, The Netherlands.

* cited by examiner

*Primary Examiner* — Jeffrey Zweizig
(74) *Attorney, Agent, or Firm* — Shaun P. Montana

(57) ABSTRACT

Systems and method for detecting failure in solid state light sources and recovering from the failure are provided. A light engine including a controller circuit and strings of solid state light sources emits light in response to drive current provided by a driver circuit. The controller circuit monitors an output voltage of the driver circuit, and detects a failure of one of the solid state light sources. The failure is associated with a change in the output voltage of the driver circuit. The controller circuit then transmits a first signal to the driver circuit in response to detecting a failure, and the driver circuit is configured to decrease the drive current in response to the first signal.

16 Claims, 7 Drawing Sheets

SOLID STATE LIGHTING DEVICE AND DRIVER CONFIGURED FOR FAILURE DETECTION AND RECOVERY

CROSS-REFERENCE TO RELATED APPLICATION

The present application claims priority of U.S. Provisional Application Ser. No. 61/709,869, filed Oct. 4, 2012 and entitled "SOLID STATE LIGHT SOURCE MODULE FAILURE DETECTION", the entire contents of which are hereby incorporated by reference.

TECHNICAL FIELD

The present invention relates to lighting, and more specifically, to solid state light sources.

BACKGROUND

A typical solid state light engine includes one or more solid state light sources (such as but not limited to light emitting diodes (LEDs), organic light emitting diodes (OLEDs), polymer light emitting diodes (PLEDs), and/or any other semiconductor device that emits light (whether in the visible spectrum or not), and/or combinations thereof, whether connected in series, parallel, and/or combinations thereof, whether formed of one or more individual semiconductor dies, one or more chips, one or more packages, and/or combinations thereof.) driven by a driver circuit. Some driver circuits output a constant current drive signal. The solid state light sources may be configured in any number of ways, such as but not limited to parallel strings of series-connected solid state light sources. The driver circuit then generates an output voltage $V_{out}$ across each of the parallel strings. The value of the output voltage may depend on the current level and the number of solid state light sources in each string.

Any individual solid state light source may fail at some point and that failure may result in an open circuit condition or a short circuit condition at that location in the circuit. Such failures may cause excess current to be diverted to the other solid state light sources and/or cause voltage surges in the light engine, which may in turn shorten the life of the remaining solid state light sources and/or the entire light engine, or result in premature failure of the light engine or damage to the driver circuit.

SUMMARY

Embodiments disclosed herein provide a driver circuit that is configured to provide a drive current to a light engine including one or more parallel strings of series-connected solid state light sources. The driver circuit and light engine may be included in a lamp assembly. A light engine controller circuit may be configured to monitor the output voltage generated by the driver circuit, which is applied across each of the strings, to detect voltage changes that may result from failure of one or more of the solid state light sources. In response to a detected voltage change, the light engine controller circuit may provide a feedback control signal to the driver circuit to reduce the drive current so that the output voltage returns to a nominal operating value.

In some embodiments, the light engine controller may signal a detected failure to a system controller that may be associated with multiple lamp assemblies, for example lamp assemblies located throughout a building or other facility. The light engine controller may also provide an identifier, or ID code, to the system controller so that the system controller can identify a lamp assembly (or light engine or string of solid state light sources) that needs to be replaced. The light engine controller (or driver circuit) may also monitor the ID code to determine when a replacement or repair has been performed so that the drive current may be restored to its original level.

In an embodiment, there is provided a system. The system includes: a light engine configured to emit light in response to a drive current, the light engine comprising a light engine controller circuit and one or more parallel strings of series-connected solid state light sources; and a driver circuit configured to provide the drive current; wherein the light engine controller circuit is configured to: monitor an output voltage of the driver circuit; detect a failure of one of the solid state light sources, the failure associated with a change in the output voltage of the driver circuit; and transmit a first signal to the driver circuit in response to detecting a failure, wherein the driver circuit is configured to decrease the drive current in response to the first signal.

In a related embodiment, the light engine controller circuit may be further configured to verify the detected failure by detecting a decrease in the output voltage to a pre-determined voltage range in response to the decrease in the drive current. In another related embodiment, the system may further include a system controller, and the system may be configured to report an error condition to the system controller, the error condition may be associated with the failure detection, and the system controller may be configured to monitor the system. In a further related embodiment, the light engine may further include a light engine identification circuit configured to identify the light engine via a light engine ID, wherein the reported error condition may include the light engine ID. In a further related embodiment, the light engine controller circuit may be further configured to detect a change in the light engine ID and to transmit a second signal to the driver circuit in response to the detected change in the light engine ID, wherein the driver circuit may be configured to increase the drive current in response to the second signal.

In another further related embodiment, the system may be further configured to communicate with the system controller over a communication path selected from the group consisting of a universal asynchronous receive transmit (UART) port, an inter-integrated circuit ($I^2C$) bus, and a serial peripheral interface (SPI) bus.

In yet another related embodiment, the light engine controller circuit may be further configured to detect a rate of change of the output voltage, and in response to the rate of change exceeding a threshold, report an error condition to a system controller. In a further related embodiment, the light engine controller circuit may be further configured to, in response to the rate of change exceeding the threshold, transmit the first signal to the driver circuit. In another further related embodiment, the light engine controller circuit may be further configured to, in response to the rate of change exceeding the threshold, latch the system. In yet another further related embodiment, the driver circuit may be a switched mode power supply circuit.

In another embodiment, there is provided a method for failure detection and recovery of a lighting system. The method includes: monitoring an output voltage of a driver circuit configured to provide a drive current to a light engine, the light engine comprising one or more parallel strings of series-connected solid state light sources; detecting a failure of one of the solid state light sources, the failure associated with a change in the output voltage of the driver circuit; transmitting a first control signal to the driver circuit in response to the failure detection; and decreasing the drive current in response to the first control signal.

In a related embodiment, the method may further include verifying the detected failure by detecting a decrease in the output voltage to a pre-determined voltage range in response to the decrease in the drive current. In another related embodiment, the method may further include reporting an error condition to a system controller, the error condition associated with the failure detection, wherein the system controller may be configured to monitor the system. In a further related embodiment, the method may further include determining a light engine ID associated with the light engine and including the light engine ID in the error report. In a further related embodiment, the method may further include detecting a change in the light engine ID and transmitting a second control signal to the driver circuit in response to the detected light engine ID change, wherein the drive current may be increased in response to the second control signal.

In still another related embodiment, the method may further include detecting a rate of change of the output voltage, and in response to the rate of change exceeding a threshold, reporting an error condition to a system controller. In a further related embodiment, the method may further include transmitting the first control signal to the driver circuit in response to the rate of change exceeding the threshold. In another further related embodiment, the method may further include latching the system in response to the rate of change exceeding the threshold.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
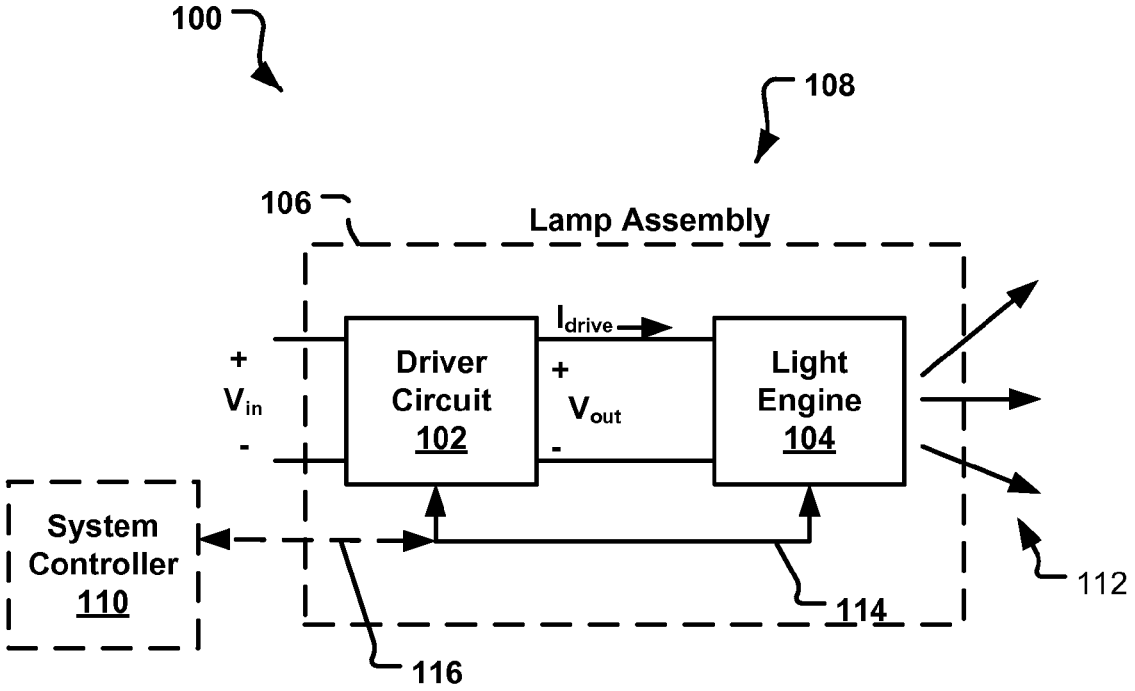
FIG. 1 shows a block diagram of a system according to embodiments disclosed herein.

FIG. 1 shows a simplified block diagram of an embodiment of a system 100 that includes a driver circuit 102 for receiving an input voltage $V_{in}$ and providing a regulated output voltage $V_{out}$ that establishes a drive current $I_{drive}$ for driving a light engine 104 to produce associated output light 112. The light engine 104 includes sets of solid state light sources arranged in parallel strings of series-connected solid state light sources. In some embodiments, the input voltage $V_{in}$ is provided directly from a 120 VAC/60 Hz line source, and in some embodiments, other alternating current (AC) or direct current (DC) voltage sources are used. For ease of explanation, the system 100 is illustrated as including a single driver circuit 102, providing a single drive current $I_{drive}$, to a single light engine 104. Those of ordinary skill in the art will recognize that some embodiments may and do include a plurality of separate light engines and one or more driver circuits configured to provide a separate associated drive current to each of the light engines. Communication between the light engine(s) and driver circuit(s) may be established using one or more communication paths and communication protocols, as described herein.

The driver circuit 102 and the light engine 104 may be, and in some embodiments are, positioned remotely from each other, e.g. in separate housings, or may be provided within the same lamp housing 106 of a lamp assembly 108. The lamp assembly 108 is configured to fit existing lighting fixtures configured to energize lamps including non-solid state light sources, e.g. fluorescent or gas-discharge sources. A lamp assembly 108 may be inserted directly into such a lighting fixture to operate on the AC input thereto.

The driver circuit 102 and the light engine 104 may be, and in some embodiments are, directly coupled by a communication path 114 for carrying communication signals according to a communication protocol. The communication path 114 may be, and in some embodiments is, a circuit configured to carry a feedback signal, such as, for example but not limited to, a pulse width modulation (PWM) signal to control a DC-DC converter in the driver circuit 102. In some embodiments, the communication path 114 and the communication protocol facilitate any suitable communication including bi-directional and full duplex communication between the driver circuit 102 and the light engine 104. The communication protocol may, and in some embodiments does, include message acknowledgements and/or error correction. Direct communication between the driver circuit 102 and the light engine 104 allows for the light engine 104 to request a change in the drive current $I_{drive}$ to compensate for variations in the monitored output voltage $V_{out}$, which may result from failure of one or more solid state light sources in any of the strings of solid state light sources. The driver circuit 102 thus dynamically adjusts the drive current $I_{drive}$ during operation of the light engine 104 to ensure that the light engine 104 continues to operate and provide light output 112. Such communication also allows the driver circuit 102 to request and receive information from the light engine 104, such as but not limited to light engine identification information.

An extension of the communication path 116 may be, and in some embodiments is, established between the driver circuit 102 and/or the light engine 104 and a system controller 110. The system controller 110 is configured to communicate directly with the driver circuit 102 and/or the light engine 104 to, for example, monitor the operational status or failure conditions of the lamp assembly 108. The system controller 110 may, and in some embodiments does, communicate with and monitor multiple lamp assemblies 108, for example, throughout a facility or building.

Figure 2:
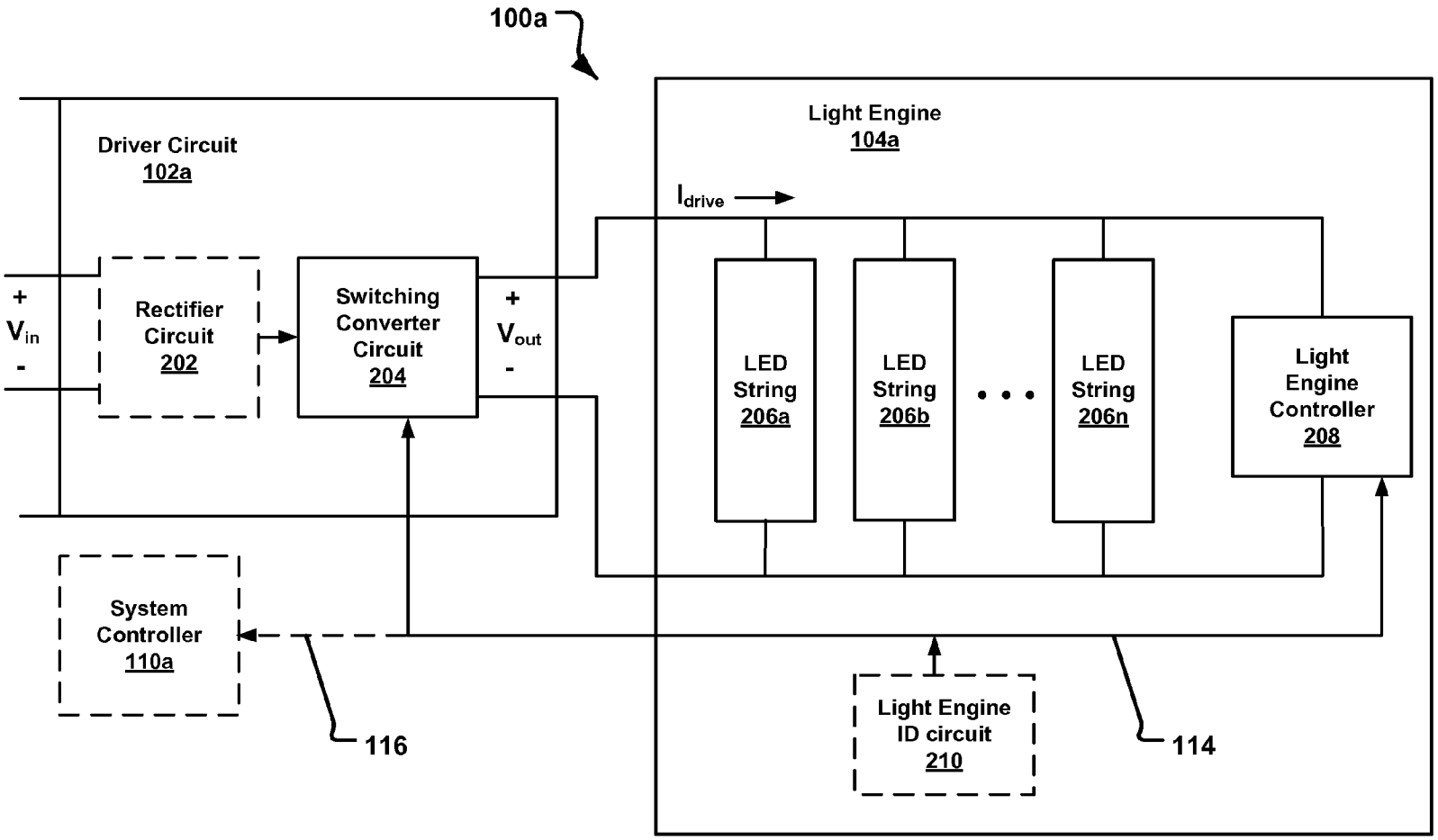
FIG. 2 is a further block diagram of the system shown in FIG. 1 according to embodiments disclosed herein.

FIG. 2 is a block diagram that conceptually illustrates the functionality of a system 100*a*. As shown, the system 100*a* includes a driver circuit 102*a*, which may include a switching converter circuit 204 (e.g., a switched mode power supply) and an optional rectifier circuit 202. The system 100*a* also includes a light engine 104*a* and an optional system controller 110*a*. The driver circuit 102*a* and the light engine 104*a* are coupled to each other by a communication path 114 that facilitates communication of communication signals between the driver circuit 102*a* and the light engine 104*a* using any suitable communication protocol. Additionally, a communication path extension 116 may be provided to an optional system controller 110*a*.

The input voltage $V_{in}$ is coupled to the switching converter circuit 204, either directly or through the rectifier circuit 202 if the input voltage is an AC voltage. A variety of rectifier circuit configurations are well-known in the art. In some embodiments, for example, the rectifier circuit 202 includes a known diode bridge rectifier or H-bridge rectifier. The switching converter circuit 204 provides drive current $I_{drive}$ to the light engine 104*a*. The switching converter circuit 204 may include any known switching regulator configuration, such as but not limited to a buck, boost, buck-boost, or flyback regulator, along with a known controller for controlling the switch within the regulator. A variety of controllers for controlling a switching regulator are well-known. In embodiments wherein the switching regulator configuration is a buck converter, for example, the controller may be a model number TPS40050 controller presently available from Texas Instruments Corporation of Dallas, Tex., USA. The switching converter circuit 204 may also include a known power factor correction (PFC) circuit configured to provide an output to the controller portion of the switching regulator, e.g. in response to a signal representative of the output of the rectifier circuit 202 and a feedback signal representative of the current through the light engine 104*a*.

The light engine 104*a* includes one or more parallel strings of series-connected solid state light sources 206*a*, 206*b*, . . . 206*n* and the light engine controller 208. The drive current $I_{drive}$ provided by the switching converter circuit 204 is directed to the solid state light source strings 206*a*, 206*b*, . . . 206*n*, such that output voltage $V_{out}$ is applied across each of the solid state light source strings 206*a*, 206*b*, . . . 206*n* causing the solid state light sources to emit light 112 (see FIG. 1). In embodiments where each solid state light source string 206*a*, 206*b*, . . . 206*n* comprises the same number and type of solid state light sources, the drive current may be divided in a substantially equal manner between each solid state light source string 206*a*, 206*b*, . . . 206*n*. For example, if there are three such parallel solid state light source strings, each string will receive one third of the drive current.

Table 1 below shows how the output voltage $V_{out}$ measured across a string of solid state light sources may depend on the drive current through the string:

TABLE 1

| Number of Solid State Light Sources | Load voltage at 700 mA | Load voltage at 1400 mA |
|---|---|---|
| 6 | 18.45 V | 20.01 V |
| 9 | 27.57 V | 29.82 V |
| 12 | 37.15 V | 40.23 V |

Figure 3:
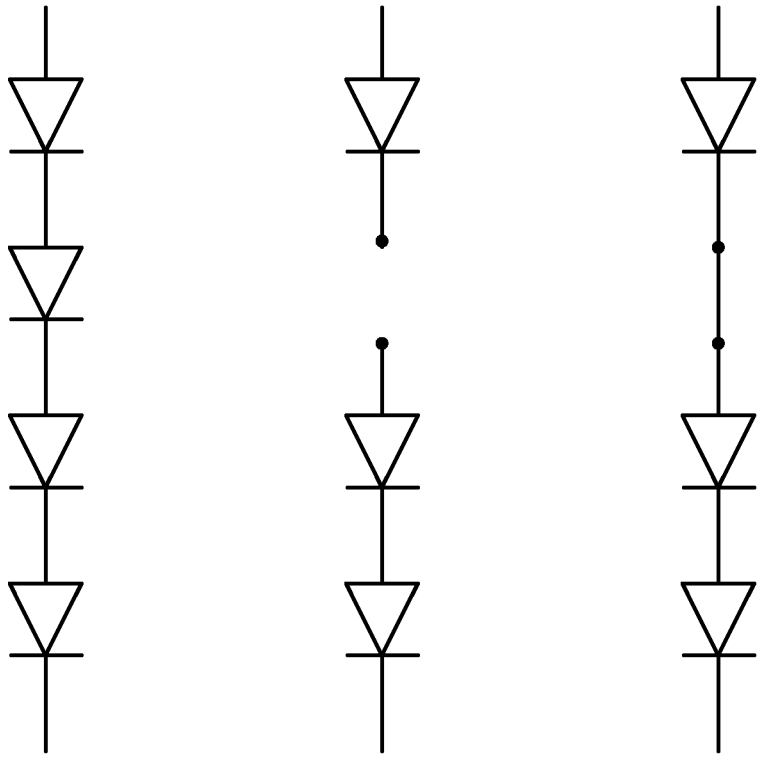
FIG. 3 diagrammatically illustrates an LED string and failure modes according to embodiments disclosed herein.

One or more solid state light sources in a string may eventually fail. For example, FIG. 3 illustrates a solid state light source string 206, including four solid state light sources, alongside two failure examples. In the first failure example 302, one of the solid state light sources fails in an open circuit condition, which may disable current flow through that string. In the second failure example 304, the solid state light source fails in a short circuit condition, which would effectively decrease the number of solid state light sources in the string and may decrease the voltage across the string. If one or more solid state light sources in a string fails (where the failure mode creates an open circuit condition at the failed solid state light source), the portion of the drive current that previously flowed through that string may be diverted through the remaining strings. For example, if there are three strings 206*a*, 206*b* and 206*c*, each carrying one third of the drive current, and a solid state light source fails in the string 206*b*, current will no longer flow through the string 206*b*. Instead, the drive current will be diverted to the remaining strings 206*a* and 206*c*, which will then each carry one half of the drive current. The voltage across the strings, $V_{out}$, will consequently rise as a result of the increased current flow through the strings. The solid state light source failure may thus be detected by monitoring the voltage across the strings $V_{out}$ to detect a voltage increase.

The light engine controller 208 is configured to monitor the voltage across the strings $V_{out}$. In response to a detected voltage increase in the voltage across the strings $V_{out}$, the light engine controller 208 causes the switching converter circuit 204 to decrease the drive current $I_{drive}$, for example by transmitting a control signal over the communication path 114, or by any other suitable mechanism. In some embodiments, the light engine controller 208 causes the drive current $I_{drive}$ to be reduced, for example in a continuous or a step-wise fashion, until the voltage across the strings $V_{out}$ returns to a nominal operational value, for example the value prior to the failure. This approach may be particularly advantageous in situations where the arrangement and number of strings of solid state light sources is not known.

In some embodiments, the light engine controller 208 determines a drive current value that is predicted to return the voltage across the strings $V_{out}$ to a nominal value based on an assumed failure of one of the strings (or of any given number of the strings) out of a known number of strings of solid state light sources. For example, if one of the three strings fails, as explained previously, the drive current in the remaining two strings may increase from one-third of the total drive current to one-half of the total drive current. Consequently, a 33% reduction in the drive current generated by the switching converter circuit 204 would be expected to restore the current in each string to the original (pre-failure) value and thus restore the voltage across the strings $V_{out}$ to the corresponding pre-failure value. The light engine controller 208 transmits a control signal to the switching converter circuit 204 to cause the generated drive current to be reduced by the determined amount associated with the presumed failure of a given number of the strings. The light engine controller 208 then verifies the failure of that given number of strings by detecting that the output voltage has returned to a nominal operational (pre-failure) value.

In some embodiments, the light engine controller 208 determines a solid state light source failure associated with a failure mode that creates an open circuit condition at the failed solid state light source, by detecting a voltage drop in the output voltage $V_{out}$. In response to detection of a failure of one or more solid state light sources, the light engine controller 208 communicates a failure report, for example to the system controller 110*a*, which may be a local controller for one or more local lamp assemblies 108 or a global controller for lighting systems throughout a building or other facility. The system controller 110*a* may be, and in some embodiments is, configured to log failures, notify personnel, and schedule repair or replacement of failed components including the strings 206, the light engines 104 and/or the lamp assemblies 108. The light engine controller 208 is further configured to control the switching converter circuit 204 to maintain the adjusted drive current at an appropriate value, as explained above, until the detected failure condition is remedied, after which the nominal driver current may be restored.

The light engine identification (ID) circuit 210 is configured to identify the light engine 104, for example with a unique value or code (i.e., a light engine ID). The light engine ID is provided to, or read by, the system controller 110, for example to identify the status and location of the lamp assemblies and to guide maintenance in response to failure reports. The light engine ID may also be, and in some embodiments is, provided to, or read by, the light engine controller 208 to determine that a light engine or string has been replaced so that the drive current may be restored to a nominal value.

In some embodiments, the light engine ID circuit 210 is implemented as a microcontroller and/or EEPROM configured to store and report an ID value. In some embodiments, the light engine ID circuit 210 is a resistor, the value of which may be read, to represent one or more bits of information. The resistance value may also be changed, for example by the light engine controller 208, the system controller 110/110*a*, and/or the driver circuit 102, by the application of a current of sufficiently high value to cause the resistor to fail to an open circuit. This may be done to indicate a failure in the light engine 104. The resistor may be coupled to the system through a separate wire or may be coupled in parallel with one or more of the strings, in which case reading or writing the value of the resistor may be accomplished through the application of a voltage of opposite polarity across the string.

In some embodiments, the light engine controller 208 is configured to monitor the rate of change of the output voltage, $d(V_{out})/dt$, and report a failure of a string, or other error condition, as previously described, in response to the rate of change of $V_{out}$ exceeding a threshold. The threshold may be associated with or correspond to a failure in a given number of the strings. For example, a failure in a single string may not be a concern while a failure of five strings may be of sufficient concern to trigger an error condition. The light engine controller 208 may also be, and in some embodiments is, configured to initiate a safe-mode in response to the rate of change of $V_{out}$ exceeding the threshold. The safe-mode may be associated with any or all of the following actions. The drive current may be reduced to a lower value. The drive current may be reduced until a nominal output voltage is reached. The lamp assembly may be shut down or latched.

Communication between elements of the system, including the light engine controller 208, the switching converter circuit 204, the system controller 110 and/or the light engine ID circuit 210 is achieved in any known way, such as but not limited to use of a universal asynchronous receive transmit (UART) port, an inter-integrated circuit ($I^2C$) bus, and/or a serial peripheral interface (SPI) bus, among others. In some embodiments, for example, one or more communication controller circuits are employed, where each communication controller circuit is a known microcontroller having internal memory and a universal asynchronous receive transmit (UART) port. One example of a microcontroller useful as a communication controller circuit is a model number C20000 microcontroller presently available from Texas Instruments Corporation of Dallas, Tex., USA. The communication paths 114 and 116 of FIG. 1 may be, for example but not limited to, a conductive path or bus coupled between the UART ports of the communication controller circuits. In general, communication controller circuits are provided with a firmware configuration that establishes a communication protocol therebetween and provides threshold settings, light engine IDs, product information such as but not limited to configuration identification information, firmware revision information, serial numbers, and the like. In some embodiments, communication may occur via an additional dedicated communication line, the switching converter circuit 204 output line(s), and combinations thereof.

Advantageously, therefore, real time communication between the light engine 104*a* and the driver circuit 102*a* allows the light engine 104*a* to request a modification of the drive current $I_{drive}$ from the driver circuit 102*a* at any time during operation of the system 100*a* to thereby offset adverse effects arising from solid state light source failures and avoid premature failure of the remaining functional solid state light sources.

Figure 4:
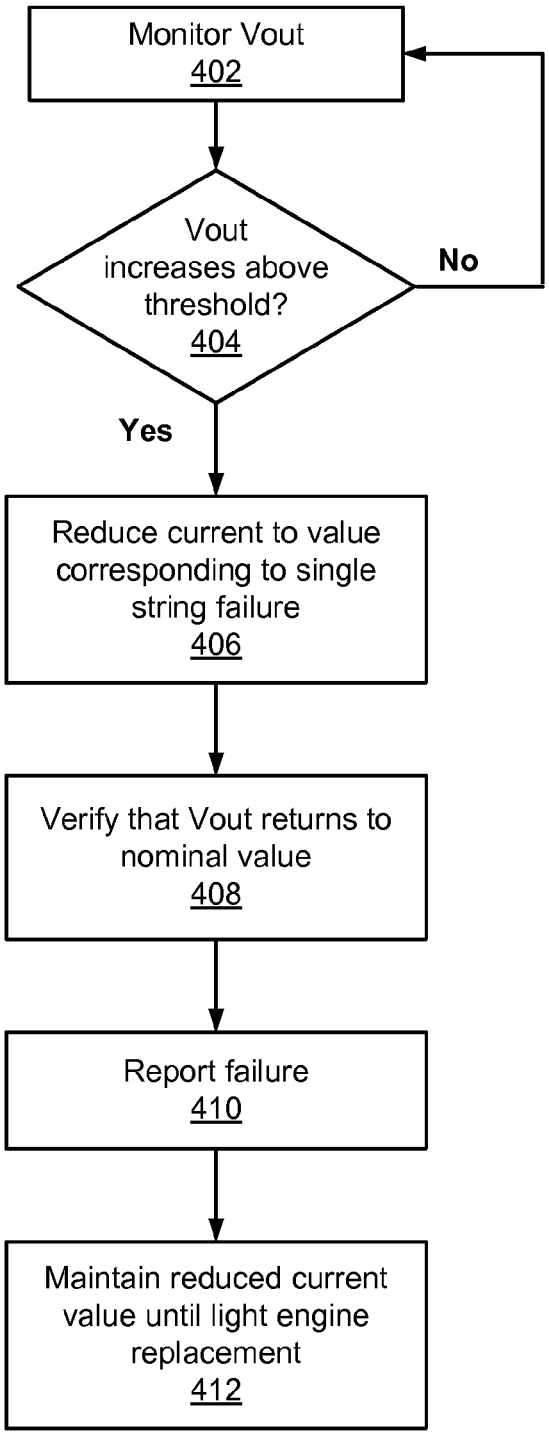
FIG. 4 is a flowchart illustrating an operation in response to an LED failure according to embodiments disclosed herein.
Figure 5:
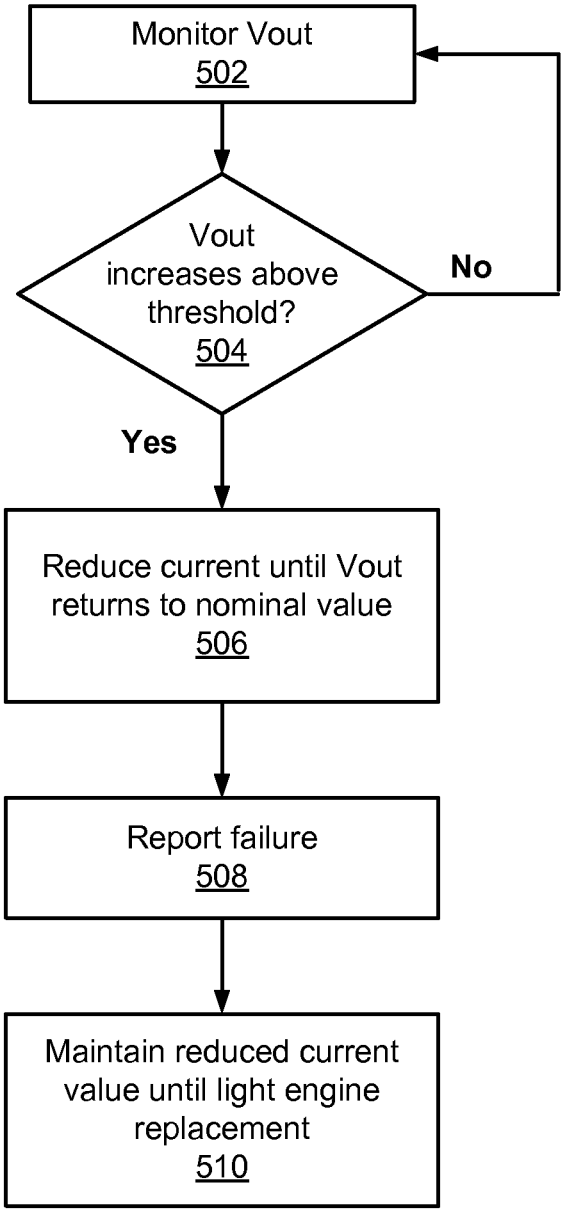
FIG. 5 is a flowchart illustrating another operation in response to an LED failure according to embodiments disclosed herein.
Figure 6:
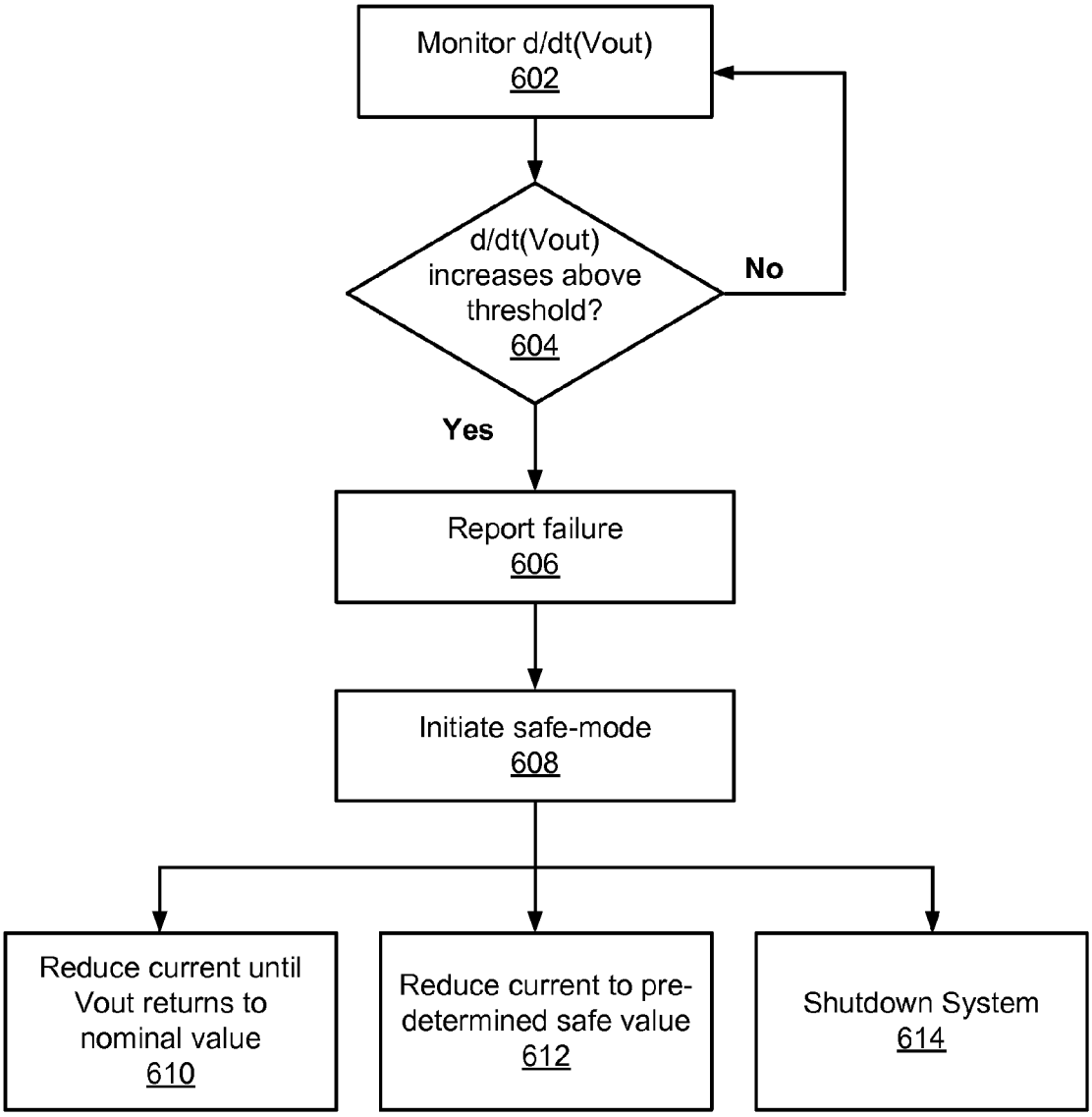
FIG. 6 is a flowchart illustrating another operation in response to an LED failure according to embodiments disclosed herein.

FIGS. 4, 5, and 6 are flowcharts illustrating how a system according to embodiments described throughout detect and recover from failures of a solid state light source in a string of solid state light sources. The illustrated flowcharts may be shown and described as including a particular sequence of steps. It is to be understood, however, that the sequence of steps merely provides an example of how the general functionality described herein may be implemented. The steps do not have to be executed in the order presented unless otherwise indicated.

In FIG. 4, a light engine controller monitors 402 an output voltage generated by a driver circuit, which may and in some embodiments does include a switching voltage converter circuit. The output voltage is applied to one or more parallel strings of series-connected solid state light sources, resulting in a drive current being delivered to the strings. If the output voltage exceeds a threshold 404, the light engine controller causes the driver circuit to reduce the driver current 406 to a value corresponding to a single string failure. The light engine controller then verifies 408 that a single string failure has occurred by detecting that the driver circuit output voltage returns to a nominal value. If the verification cannot be achieved, the light engine controller causes the driver circuit to reduce the driver current further to a value corresponding to a failure of two strings, which may then be verified. The process is continued as needed for increasing numbers of string failures. The light engine controller also generates a failure report 410, which may be, and in some embodiments is, sent to a system controller. The reduced driver current value is maintained until the light engine is replaced or repaired 412.

In FIG. 5, a light engine controller monitors 502 an output voltage generated by a driver circuit, which may and in some embodiments does include a switching voltage converter circuit. The output voltage is applied to one or more parallel strings of series-connected solid state light sources, resulting in a drive current being delivered to the strings. If the output voltage exceeds a threshold 504, the light engine controller causes the driver circuit to reduce the driver current 506 until the driver circuit output voltage returns to a nominal value. The light engine controller also generates a failure report 508, which is sent to a system controller. The reduced driver current value is maintained until the light engine is replaced or repaired 510.

In FIG. 6, a light engine controller monitors 602 the rate of change of an output voltage generated by a driver circuit, which may and in some embodiments does include a switching voltage converter circuit. The output voltage is applied to one or more parallel strings of series-connected solid state light sources, resulting in a drive current being delivered to the strings. If the rate of change of the output voltage exceeds a threshold 604, the light engine controller generates a failure report 606, which is sent to a system controller, and initiates a safe-mode of operation 608. The safe-mode of operation may be, and in some embodiments is, associated with any or all of the following actions: the drive current is reduced until a nominal output voltage is reached 610, the drive current is reduced to a lower pre-determined safe operating value 612, the lamp assembly is shut down or latched 614.

Figure 7:
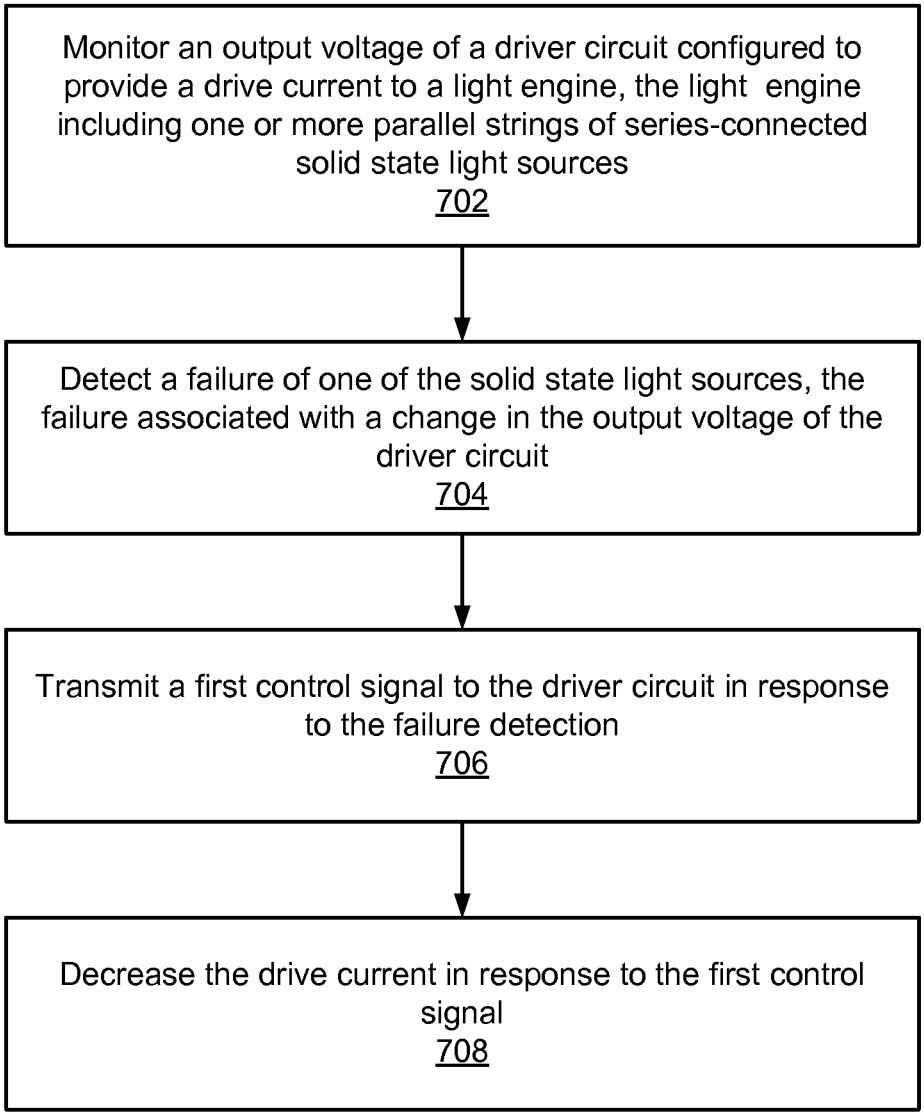
FIG. 7 is a flowchart illustrating a method of detecting and responding to an LED failure according to embodiments disclosed herein.

FIG. 7 is a flowchart illustrating a method 700 of adjusting the output light of a light engine. In FIG. 7, an output voltage of a driver circuit is monitored 702. The driver circuit is configured to provide a drive current to a light engine, the light engine including one or more parallel strings of series-connected solid state light sources. At operation 704, failure of one of the solid state light sources is detected. The failure is associated with a change in the output voltage of the driver circuit. A first control signal is transmitted 706 to the driver circuit in response to the failure detection. The drive current is decreased 708 in response to the first control signal.

Embodiments are not limited to power supplies that include a single output channel, but may be extended to multichannel power supplies. Embodiments may function with any number of strings connected in parallel, with each string having any number of solid state light sources. Further, in some embodiments, a string itself may include two or more sub-strings connected in parallel. Of course, the verification method described above would need to be adjusted for sub-strings, such that the current through each sub-string would need to be regulated appropriately to determine if a sub-string included the failed solid state light source(s).

The methods and systems described herein are not limited to a particular hardware or software configuration, and may find applicability in many computing or processing environments. The methods and systems may be implemented in hardware or software, or a combination of hardware and software. The methods and systems may be implemented in one or more computer programs, where a computer program may be understood to include one or more processor executable instructions. The computer program(s) may execute on one or more programmable processors, and may be stored on one or more storage medium readable by the processor (including volatile and non-volatile memory and/or storage elements), one or more input devices, and/or one or more output devices. The processor thus may access one or more input devices to obtain input data, and may access one or more output devices to communicate output data. The input and/or output devices may include one or more of the following: Random Access Memory (RAM), Redundant Array of Independent Disks (RAID), floppy drive, CD, DVD, magnetic disk, internal hard drive, external hard drive, memory stick, or other storage device capable of being accessed by a processor as provided herein, where such aforementioned examples are not exhaustive, and are for illustration and not limitation.

The computer program(s) may be implemented using one or more high level procedural or object-oriented programming languages to communicate with a computer system; however, the program(s) may be implemented in assembly or machine language, if desired. The language may be compiled or interpreted.

As provided herein, the processor(s) may thus be embedded in one or more devices that may be operated independently or together in a networked environment, where the network may include, for example, a Local Area Network (LAN), wide area network (WAN), and/or may include an intranet and/or the internet and/or another network. The network(s) may be wired or wireless or a combination thereof and may use one or more communications protocols to facilitate communications between the different processors. The processors may be configured for distributed processing and may utilize, in some embodiments, a client-server model as needed. Accordingly, the methods and systems may utilize multiple processors and/or processor devices, and the processor instructions may be divided amongst such single- or multiple-processor/devices.

The device(s) or computer systems that integrate with the processor(s) may include, for example, a personal computer(s), workstation(s) (e.g., Sun, HP), personal digital assistant(s) (PDA(s)), handheld device(s) such as cellular telephone(s) or smart cellphone(s), laptop(s), handheld computer(s), or another device(s) capable of being integrated with a processor(s) that may operate as provided herein. Accordingly, the devices provided herein are not exhaustive and are provided for illustration and not limitation.

References to "a microprocessor" and "a processor", or "the microprocessor" and "the processor," may be understood to include one or more microprocessors that may communicate in a stand-alone and/or a distributed environment(s), and may thus be configured to communicate via wired or wireless communications with other processors, where such one or more processor may be configured to operate on one or more processor-controlled devices that may be similar or different devices. Use of such "microprocessor" or "processor" terminology may thus also be understood to include a central processing unit, an arithmetic logic unit, an application-specific integrated circuit (IC), and/or a task engine, with such examples provided for illustration and not limitation.

Furthermore, references to memory, unless otherwise specified, may include one or more processor-readable and accessible memory elements and/or components that may be internal to the processor-controlled device, external to the processor-controlled device, and/or may be accessed via a wired or wireless network using a variety of communications protocols, and unless otherwise specified, may be arranged to include a combination of external and internal memory devices, where such memory may be contiguous and/or partitioned based on the application. Accordingly, references to a database may be understood to include one or more memory associations, where such references may include commercially available database products (e.g., SQL, Informix, Oracle) and also proprietary databases, and may also include other structures for associating memory such as links, queues, graphs, trees, with such structures provided for illustration and not limitation.

References to a network, unless provided otherwise, may include one or more intranets and/or the internet. References herein to microprocessor instructions or microprocessor-executable instructions, in accordance with the above, may be understood to include programmable hardware.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A system, comprising:

a light engine configured to emit light in response to a drive current, the light engine comprising a light engine controller circuit and one or more parallel strings of series-connected solid state light sources; and a driver circuit configured to provide the drive current;

wherein the light engine controller circuit is configured to:

monitor an output voltage of the driver circuit;

detect a failure of one of the solid state light sources, the failure associated with a change in the output voltage of the driver circuit; and transmit a first signal to the driver circuit in response to detecting a failure, wherein the driver circuit is configured to decrease the drive current in response to the first signal;

wherein the light engine controller circuit is further configured to detect a rate of change of the output voltage, and in response to the rate of change exceeding a threshold, report an error condition to a system controller.

2. The system of claim 1, wherein the light engine controller circuit is further configured to verify the detected failure by detecting a decrease in the output voltage to a pre-determined voltage range in response to the decrease in the drive current.

3. The system of claim 1, wherein the system further comprises a system controller, and wherein the system is configured to report an error condition to the system controller, wherein the error condition is associated with the failure detection, and wherein the system controller is configured to monitor the system.

4. The system of claim 3, wherein the light engine further comprises a light engine identification circuit configured to identify the light engine via a light engine ID, wherein the reported error condition includes the light engine ID.

5. The system of claim 4, wherein the light engine controller circuit is further configured to detect a change in the light engine ID and to transmit a second signal to the driver circuit in response to the detected change in the light engine ID, wherein the driver circuit is configured to increase the drive current in response to the second signal.

6. The system of claim 3, wherein the system is further configured to communicate with the system controller over a communication path selected from the group consisting of a universal asynchronous receive transmit (UART) port, an inter-integrated circuit (I2C) bus, and a serial peripheral interface (SPI) bus.

7. The system of claim 1, wherein the light engine controller circuit is further configured to, in response to the rate of change exceeding the threshold, transmit the first signal to the driver circuit.

8. The system of claim 1, wherein the light engine controller circuit is further configured to, in response to the rate of change exceeding the threshold, latch the system.

9. The system of claim 1, wherein the driver circuit is a switched mode power supply circuit.

10. A method for failure detection and recovery of a lighting system, comprising:

monitoring an output voltage of a driver circuit configured to provide a drive current to a light engine, the light engine comprising one or more parallel strings of series-connected solid state light sources;

detecting a failure of one of the solid state light sources, the failure associated with a change in the output voltage of the driver circuit;

transmitting a first control signal to the driver circuit in response to the failure detection;

decreasing the drive current in response to the first control signal; and detecting a rate of change of the output voltage, and in response to the rate of change exceeding a threshold, reporting an error condition to a system controller.

11. The method of claim 10, further comprising verifying the detected failure by detecting a decrease in the output voltage to a pre-determined voltage range in response to the decrease in the drive current.

12. The method of claim 10, further comprising reporting an error condition to a system controller, the error condition associated with the failure detection, wherein the system controller is configured to monitor the system.

13. The method of claim 12, further comprising determining a light engine ID associated with the light engine and including the light engine ID in the error report.

14. The method of claim 13, further comprising detecting a change in the light engine ID and transmitting a second control signal to the driver circuit in response to the detected light engine ID change, wherein the drive current is increased in response to the second control signal.

15. The method of claim 10, further comprising transmitting the first control signal to the driver circuit in response to the rate of change exceeding the threshold.

16. The method of claim 10, further comprising latching the system in response to the rate of change exceeding the threshold.

* * * * *